United States Patent [19]

Janko et al.

[11] Patent Number: 5,035,345

[45] **Date of Patent: * Jul. 30, 1991**

[54] AUTOMATIC INFLATOR FOR INFLATABLE ARTICLES

[75] Inventors: Michael Janko, Anchorville; Ray Moran, Grosse Pointe Farms; Norman Carlson, Rochester, all of Mich.

[73] Assignee: APOC, Inc., New Baltimore, Mich.

[ * ] Notice: The portion of the term of this patent subsequent to Nov. 27, 2007 has been disclaimed.

[21] Appl. No.: 519,749

[22] Filed: May 7, 1990

[51] Int. Cl.[5] ..... B67D 5/00

[52] U.S. Cl. ..... 222/5; 222/41; 222/63; 441/93

[58] Field of Search ..... 222/3, 5, 41, 54, 63, 222/333, 81, 83; 441/41, 92, 93, 94, 95

[56] References Cited

U.S. PATENT DOCUMENTS

| | | |
|---|---|---|
| 1,329,990 | 2/1920 | Müller . |
| 2,527,605 | 10/1950 | Walk . |
| 2,627,998 | 2/1953 | Musser et al. . |
| 2,675,143 | 4/1954 | Seemann, Jr. . |
| 2,701,886 | 2/1955 | Ivie . |
| 2,894,658 | 7/1959 | Spidy . |
| 2,904,217 | 9/1959 | Gurney . |
| 2,944,268 | 7/1960 | Fruendt . |
| 2,964,050 | 12/1960 | Novak . |
| 3,059,814 | 10/1962 | Poncel et al. . |
| 3,077,288 | 2/1963 | Henry . |
| 3,090,979 | 5/1963 | Segrest . |
| 3,127,624 | 4/1964 | Kubit et al. . |
| 3,193,140 | 7/1965 | Trauger . |
| 3,198,384 | 8/1965 | Anderson . |
| 3,221,932 | 12/1965 | Anderson . |
| 3,242,514 | 3/1966 | Waters . |
| 3,266,668 | 8/1966 | Davis . |
| 3,308,464 | 3/1967 | Licher . |
| 3,350,730 | 11/1967 | Kubit et al. . |
| 3,426,942 | 2/1969 | McMains et al. . |
| 3,494,506 | 2/1970 | Fujimoto . |
| 3,510,025 | 5/1970 | Turner et al. . |
| 3,526,339 | 9/1970 | Bernhardt et al. . |
| 3,630,413 | 12/1971 | Beckes et al. . |
| 3,682,354 | 8/1972 | Witte . |
| 3,693,202 | 9/1972 | Ohtani . |
| 3,716,882 | 2/1973 | Middleton, Jr. et al. . |

(List continued on next page.)

*Primary Examiner*—Michael S. Huppert
*Assistant Examiner*—Gregory L. Huson
*Attorney, Agent, or Firm*—Basile and Hanlon

[57] ABSTRACT

An inflator for automatically inflating an inflatable article, such as a personal flotation vest, upon immersion in water. A plunger and a piercing pin are movably mounted within a housing and are movable with respect to a pressurized gas canister attached to the housing. A force generating mechanism, mounted within the housing, acts on the plunger to forcibly move the plunger and the piercing pin to pierce the canister to release the pressurized gas therefrom through the housing to an inflatable article attached to the housing. A pair of spaced water sensor probes mounted in the housing provide a signal to a control device indicating that the housing is immersed in water. The control device activates a release mechanism which rotates a cam to release a spring-biased ram in the force generating mechanism from a first, retracted position such that the ram engages the plunger and urges the plunger and the piercing pin under force into the sealed end of the gas canister. The release mechanism, in a preferred embodiment, includes a motor actuated by the control device and gears which couple the motor output shaft to the cam which holds the ram in a first, retracted position. A manual lanyard is connected to a shaft extensibly mounted within the housing. A link connected to the shaft includes a cam which acts on the plunger to manually urge the plunger and the piercing pin into the gas canister when the lanyard shaft is pulled outward from the housing. An externally rotatable cap is mounted on the housing and internally engages the ram to retract the ram to the first position and allow the control device to rotate the cam to the first position to block the ram in the first position.

36 Claims, 4 Drawing Sheets

U.S. PATENT DOCUMENTS 3,802,012 4/1974 Middleton, Jr. .
3,812,546 5/1974 Witte .
3,815,783 6/1974 Hirata .
3,833,029 9/1974 Munn .
3,910,457 10/1975 Sutliff et al. .
3,934,292 1/1976 Mulderrig .
3,997,079 12/1976 Niemann .
4,024,440 5/1977 Miller .
4,094,028 6/1978 Fujiyama et al. .
4,191,310 4/1980 Bernhardt et al. .
4,223,805 9/1980 Mackal .
4,246,672 1/1981 Fujiyama et al. .
4,260,075 4/1981 Mackal .
4,267,944 5/1981 Mackal .
4,475,664 10/1984 Mackal .
4,482,081 11/1984 Meggs .
4,493,664 1/1985 Dale .
4,498,604 2/1985 Mackal et al. .
4,498,605 2/1985 Mackal et al. .
4,500,014 2/1985 Zimmerly .
4,524,885 6/1985 Zimmerly .
4,629,436 12/1986 Stewart et al. .
4,927,057 5/1990 Janko et al. ..... 222/5
4,946,067 8/1990 Kelsall ..... 222/5

AUTOMATIC INFLATOR FOR INFLATABLE ARTICLES

CROSS REFERENCE TO RELATED APPLICATIONS

This application is related to U.S. patent application Ser. No. 07/359,875, filed May 30, 1989, and now U.S. Pat. No. 4,927,057, in the names of M. Janko and M. McAllister for an Automatic Inflator for Inflatable Articles, and U.S. patent application Ser. No. 07/373,207 filed June 29, 1989 and now U.S. Pat. No. 4,972,971, in the names of M. Janko, R. Moran, N. Carlson and J. Moran for an Automatic Inflator for Inflatable Articles.

BACKGROUND OF THE INVENTION

Field of the Invention

The present invention relates, in general, to inflatable articles and, more specifically, to inflators for inflatable articles, such as personal flotation devices, life vests, rafts, etc.

Personal flotation devices (PFDs), commonly known as life vests or jackets, and other inflatable articles, such as rafts, etc., have been devised to inflate and serve as a flotation device for a person immersed in water. Such devices typically employ a pressurized gas canister or cylinder, such as a carbon dioxide cylinder, which, when pierced, releases gas to inflate the attached article. A manual operating lever or lanyard is employed to move a spring biased pin into the gas canister to pierce and release the gas therefrom.

While such devices are effective, such manually operated inflators require the use of energy by the wearer to activate the inflator to release the gas to inflate the article. If the wearer is disabled or unconscious, he is unable to actuate the inflator to inflate the article.

To overcome such a problem, automatic inflators have been devised which singly, or in combination with a manual lanyard, automatically inflate a vest or raft when immersed in water. Such automatic inflators typically include a pill or a member formed of a material which is responsive to water and which dissolves or changes in volume or dimension when subject to water. The pill or member, when altered, releases a spring-loaded striker or plunger to pierce the gas canister and release the gas therefrom to inflate the attached article. In other such devices, the disintegration of the pill or member upon exposure to moisture or water causes an explosive charge to detonate to actuate the canister piercing pin.

While such actuators automatically inflate articles without manual intervention, they are not without their deficiencies. Such actuators take a measurable amount of time, i.e., several seconds, for the pill to disintegrate before actuating the device to release the gas and inflate the article. This time delay may be critical in certain uses to prevent injury or drowning of the wearer of the inflatable article. Further, such automatic inflators are relatively unreliable in that they have been proven to operate only two-thirds of the time when exposed to water. Further, such automatic inflators provide little or no ready indication of a fully charged gas canister or any indication of an operative inflator.

Improved automatic inflators have been devised which utilize probes or conductors mounted in the inflator body and which form a part of an electrical circuit used to automatically drive a plunger into the pressurized gas canister. When the housing is fully immersed in water, a circuit is closed between the probes which supplies electric power to an actuating mechanism, i.e., such as an explosive charge which detonates to drive the plunger into the canister. While such inflators are an improvement over previously devised automatic inflators, care must be taken to prevent premature actuation due to a splash of water when the housing is not fully immersed in water. Further, such improved automatic inflators still provide no indication of a spent or empty gas canister nor the operative state of the inflator actuating mechanism.

Further, such previously devised inflators require the replacement of certain parts, such as the water soluble member or the detonator, before they can be used again. This adds to the cost of the inflator and minimizes its efficient usage over a long period of time.

Certain automatic inflators have been devised which address most of these deficiencies, such as those noted in the above "Cross Reference to Related Applications." In one of these devices, a control unit, in response to a signal from water sensor probes, activates a motor-gear means to rotate a cam which engages a plunger mounted in a sealed housing and urges the plunger and a piercing pin attached to the end of the plunger forcibly into a sealed gas canister. In the other device, the control means, in response to an output from a water sensor, activates a motor-gear means which retracts a slider allowing a spring biased ram to move under spring force and drive a plunger and piercing pin into the sealed gas canister. In this device, the force of the ram acting on the slider is at a 90° angle with respect to the slider which results in high frictional forces and motor loads. This leads to the need for larger motors which increases the overall size of the automatic inflator. However, while these automatic inflators overcome many of the deficiencies found with previously devised automatic inflators for inflatable articles, it has been found that further improvements could be made to these automatic inflators to improve their reliability, reduce their size and the number of individual components, as well as to simplify their construction.

Thus, it would be desirable to provide an automatic inflator for inflatable articles which automatically inflates an inflatable device without user intervention. It would also be desirable to provide an automatic inflator which quickly inflates an inflatable article when immersed in water. It would also be desirable to provide an automatic inflator which can be internally reset for successive operations without the need for replacing spent parts. Finally, it would be desirable to provide an automatic inflator for inflatable articles which provides an easily visible indication of the condition of the gas canister, i.e., whether charged or pierced, as well as the operative state of the inflator actuating mechanism.

SUMMARY OF THE INVENTION

The present invention is an automatic inflator for inflatable articles which automatically releases pressurized gas to inflate such articles upon immersion in water. The inflator includes a housing having means for discharging pressurized gas to an attachable inflatable article. A pressurized gas canister is removably attached to the housing and is disposed in fluid flow communication with the gas discharging means in the housing. A canister piercing means is movably mounted within the housing with respect to and facing the gas canister for piercing the sealed end of the canister.

An electrical power source is mounted in the housing and is connected to a water sensor means, also mounted on the housing. The water sensor means detects immersion of the housing in water and outputs a signal to a control means.

A force generating means is mounted in the housing for driving the canister piercing means into the sealed end of the canister.

A rotatable release means is rotatably mounted in the housing and rotates between first and second positions for blocking the force generating means from engaging the canister piecing means when the release means is in the first position and allowing the force generating means to forcibly engage the canister piercing means when the release means is in the second position. Actuator means are mounted in the housing for rotating the release means between the first and second positions in response to an output signal from the water sensor means.

In a preferred embodiment, the force generating means comprises a ram slidably mounted in the housing and movable between a first, retracted position and a second, extended position in which the ram acts on the canister piercing means. A first biasing means, such as a coil spring, is mounted in the housing for biasing the ram under spring force toward the second, extended position. The rotatable release means preferably comprises a cam means rotatably mounted in the housing. In a first position, the cam blocks the ram from movement from the first, retracted position and, when rotated to the second position, allows the ram to slide forward under the spring force of the first biasing means and engage and drive the canister piercing means into the sealed end of the canister. The canister piercing means preferably comprises a plunger movably mounted in the housing in front of the ram and facing the gas canister. A canister piercing pin is mounted on and extends outward from a forward end of the plunger. The actuator means preferably comprises means for moving the cam means between the first and second positions and electrical control means, mounted in the housing and connected to the electrical power source, the cam moving means and the water sensor means, for activating the cam moving means to move the cam means from the first to the second position in response to an output signal from the water sensor means.

The cam moving means preferably comprises a motor mounted in the housing. A gear is mounted on the output shaft of the motor and engages a second gear fixedly coupled to the cam means for rotating the cam means between the first and second positions upon activation of the motor.

Means are also provided for resetting the inflator for subsequent piercing of another sealed gas canister. The resetting means comprises a cap rotatably mounted to the housing. The cap includes an internal bore which slidingly receives a sleeve. The sleeve is transversely movable within the bore in the cap and includes a first threaded end which threadingly engages threads formed in a bore in the housing for extension and retraction as the cap is rotated. The ram is slidably disposed within and extends through the sleeve. The first biasing means is mounted about the ram and within the sleeve and acts on the ram. Stop means are provided on the end of the ram and engaged by the sleeve as the sleeve is retracted upon rotation of the cap to urge the ram to the first, retracted position.

The automatic inflator of the present invention also includes manual activating means for urging the plunger and the piercing pin into a sealed gas canister. The manual actuating means preferably comprises a shaft slidably mounted in a bore in the housing. The shaft has a first end extending outward from the housing. A cord is connected to the first end of the shaft for transversely moving the shaft outward from the housing. A link having first and second ends is mounted within a cavity formed in the plunger. The first end of the link is pivotally mounted to the housing. The second end of the link is connected to the shaft. Cam means are formed on the first end of the link and act on the plunger to urge the plunger and the piercing pin towards the canister when the shaft is transversely pulled outward from the housing.

In another embodiment, the inflator of the present invention includes means for detecting the position of the plunger to provide an indication of the operative condition of the gas canister. In this manner, a ready indication through a visible indicator mounted on the housing is provided to indicate whether the canister is fully charged or has been pierced and is empty. An additional indicator is also provided in the housing and driven by the control means to indicate that the inflator, i.e., the ram, has been reset. In the reset state, the ram is in its first, retracted position, the cam has been rotated to its first position blocking advance of the ram and a sealed gas canister has been mounted in the housing.

The inflator of the present invention automatically inflates an inflatable article attached thereto with pressurized gas immediately or a preset time after immersion in water. The water sensor probes are mounted in the housing in such a manner as to prevent the generation of an output signal therefrom due only to a splash or a momentary contact with water. This requires that the sensors be fully immersed in water before generating an output signal to activate the inflator.

The inflator includes both automatic, as well as manual activating means. Most importantly, the inflator of the present invention provides visible indication of the state of the gas canister, i.e., whether fully charged or empty. In addition, the control means drives several indicators which provide a visible indication of the operative state of the inflator, as well as the presence of any fault condition which would prevent the operation of the inflator in an automatic mode. The inflator of the present invention is of simple construction and contains a minimal number of components for a small size and reduced manufacturing cost. The use of the motor/-gear/cam means provides a simple, low cost, low frictional means for releasing the spring biased ram to cause the plunger and the piercing pin to pierce a sealed gas cainster. Further, the cap, sleeve and ram cooperate to enable the ram to be easily reset to its retracted position and the cam automatically rotated by the control means to its first position blocking advance of the ram toward the plunger. This reset state is indicated by an indicator on the housing to provide a visible indication of the operative state of the inflator. Further, the unique construction of the lanyard simplifies the manual activation of the inflator and eliminates any potential failures thereby providing a long reliable life for the automatic inflator of the present invention.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
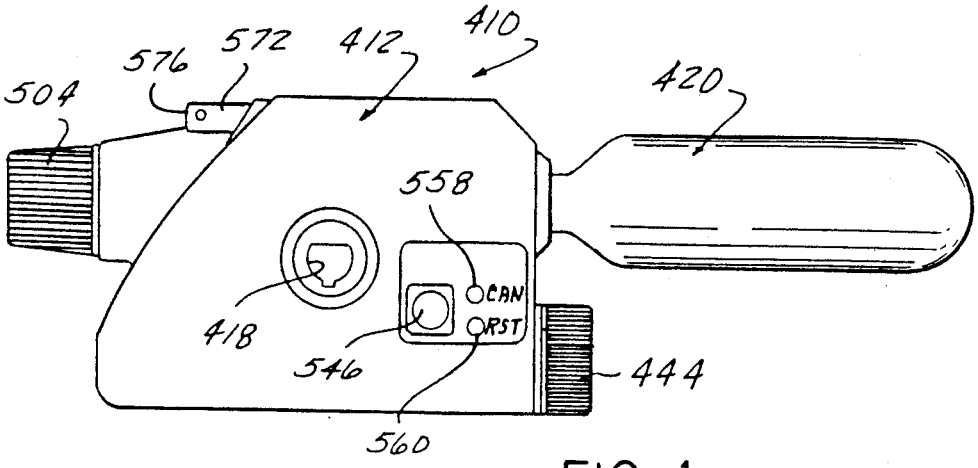
FIG. 1 is a front elevational view of an automatic inflator constructed in accordance with the teachings of the present invention.

Throughout the following description and drawing, an identical reference number is used to refer to the same component shown in multiple figures of the drawing.

Figure 2:
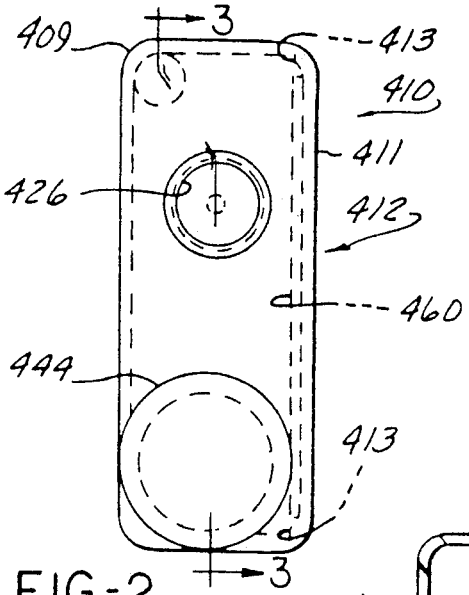
FIG. 2 is a right hand end view of the automatic inflator shown in FIG. 1.

Referring now to the drawing, and to FIGS. 1 and 2, in particular, there is illustrated an inflator 410 for inflating an inflatable article, such as a personal flotation device, raft, etc. The inflatable article with which the inflator 410 is used may comprise any type of article which is inflated by pressurized gas released from the inflator 410.

The inflator 410 includes a waterproof housing 412, preferably formed of a plastic material. The housing 412 is formed of a case 409 and a cover 411 which are insert-molded together along a common seam or joint 413 to form a waterproof enclosure about the internal components of the inflator 410 housed within the housing 412. The case 409 is hollow or has cored out cavities for receiving the various components, described hereafter. Alternately, the case 409 and the cover 411 are ultrasonically welded together at the joint 413.

Figure 6:
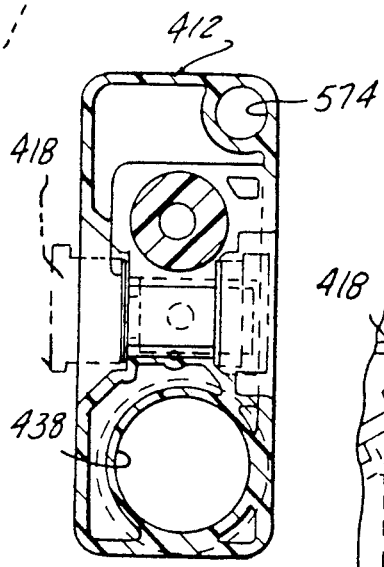
FIG. 6 is a cross sectional view generally taken along line 6—6 in FIG. 3.
Figure 7:
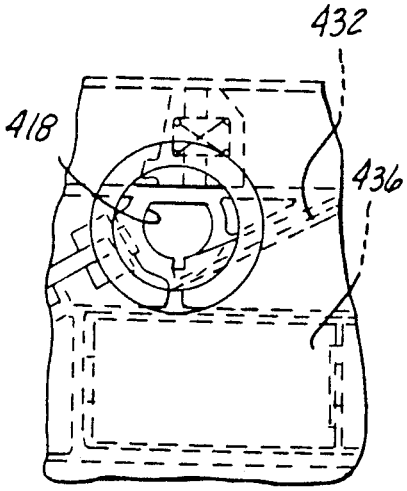
FIG. 7 is an enlarged view of a portion of the inflator shown in FIG. 3.
Figures 3, 8:
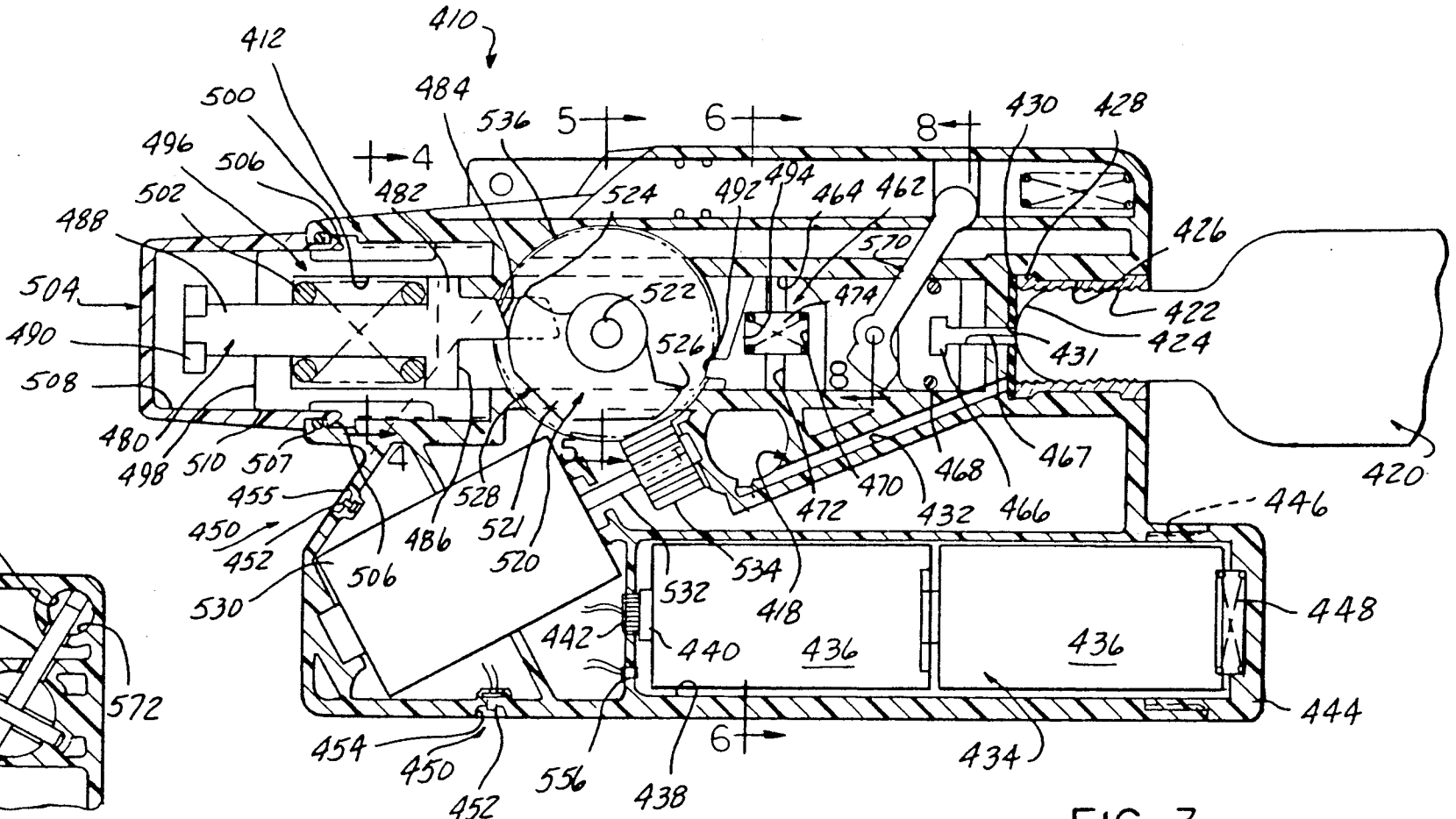
FIG. 3 is a cross sectional view generally taken along line 3—3 in FIG. 2 and showing the internally mounted components of the automatic inflator shown in FIG. 1.
FIG. 8 is a cross sectional view generally taken along line 8—8 in FIG. 3.

As shown in FIG. 3, the housing 412 includes a fluid flow conduit 432 which is connectible at one end to a valve 418. Any suitable valve 418, such as a quick release valve, may be mounted to the housing 412 to attach the inflator housing 412 to the inflatable article. Such mounting means may be permanent or removable, as described. As shown in FIG. 6, the quick release valve 418 is mounted centrally through the housing 412 and includes an outwardly extending portion which is releasably attachable to an inflatable article.

A pressurized gas canister 420 is releasably attachable to the housing 412. The gas cansiter 420 may comprise any conventional pressurized gas canister, such as one containing carbon dioxide ($CO_2$) or any other fluid commonly employed to inflate an inflatable article. The canister 420 is preferably in the form of a metal container having a threaded end portion 422 formed adjacent one end and a pierceable sealed end portion 424 situated adjacent the threaded end portion 422 and facing outward from one end of the canister 420. The threads 422 on the gas canister 420 are threadingly received in a threaded bore 426 in a metallic insert 428 which is molded or otherwise sealingly mounted in the housing 412. A face seal 430 is mounted at one end of the bore 426 which receives the sealed end 424 of the gas canister 420. An aperture 431 extends centrally through the face seal 430 for receiving a piercing pin, as described hereafter. The aperture 431 is disposed in fluid flow communication with one end of the gas flow conduit 432.

An electric power source, denoted in general by reference number 434, is mounted within the housing 412 and provides electrical power to the electrically operated components of the inflator 410. The electric power source 434 preferably comprises one or more storage batteries 436. In a preferred embodiment, two lithium batteries 436 are mounted end-to-end in series within a bore 438 formed in the housing 412. As shown in FIG. 3, the two batteries 436 are placed in the housing 412 with their positive ends first-most into the bore 438. The contact 440 on the left endmost battery 436 engages a battery contact 442 mounted in the housing 412 at the end of the bore 438. Preferably, the battery contact 442 is insert-molded in the housing 412 to prevent water and battery content leakage into the main body of the housing 412. In addition, it is preferred that the battery contact 442 be gold-plated to prevent corrosion and galvanic action.

Although the batteries 436 may be permanently mounted into the housing and an end cap sealingly and fixedly attached thereover, it is preferred that a threaded battery cap 444 be provided to enable the batteries 436 to be replaced, as needed. As shown in FIG. 3, the battery cap 444 includes internal threads 446 which threadingly engage external threads formed on a boss on one end of the housing 412. The battery cap 444 contains a centrally mounted spring 448 which extends from the inner surface of the cap 444 and biases the batteries 436 into contact with each other and the battery contact 442 in the housing 412.

Water sensor means, denoted in general by reference number 450 in FIG. 3, is mounted in the housing 412. Preferably, the water sensor means 450 comprises two electric probes 452 which are mounted in separate, spaced recesses 454 and 455 formed along two adjacent edges of the housing 412. The probes 452 are insert-molded in the housing 412 and extend outward from the housing 412 within the recesses 454 and 455. Thus, the probes 452 are completely surrounded by the peripheral extent of the recesses 454 and 455 to prevent a splash or drop of water from forming a conductive path between the probes 452 which would inadvertently activate the inflator 410. The electric leads or conductors from the water sensor probes 452 are connected to a control means, described in detail hereafter.

Figure 9:
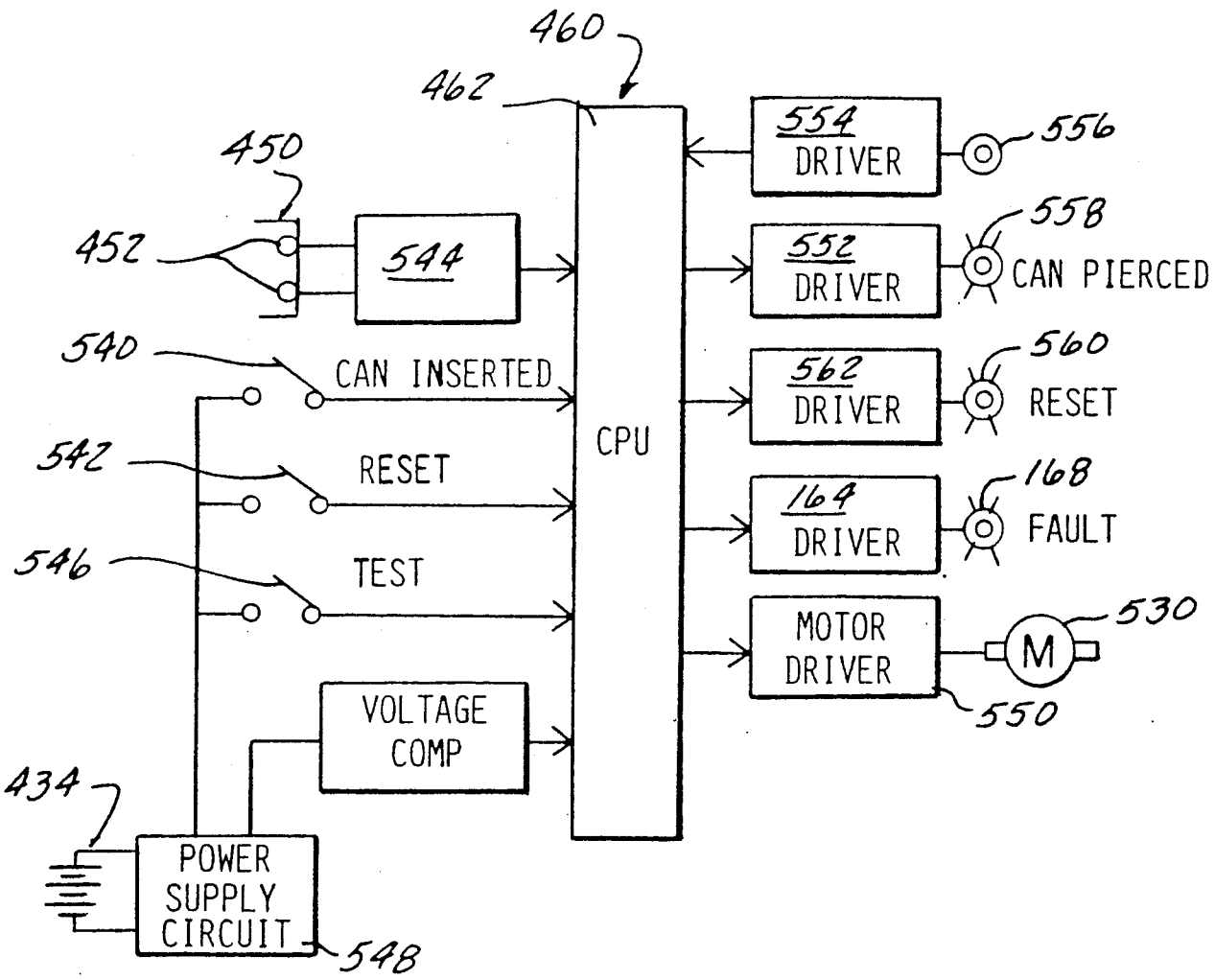
FIG. 9 is a schematic block diagram of the control means employed in the automatic inflator of the present invention.

The control means 460, FIG. 9, may comprise any type of electric circuit suitable for activating the inflator 410 in response to an output signal from the water sensor means 450. Thus, a discrete component electric circuit may be employed for the control means 460. In a preferred embodiment, however, the control means 460 comprises a central processing unit 462, such as a National Semiconductor microcomputer, Model No.

COP413C, which executes a stored control program and activates the inflator 410 in response to an output signal from the water sensor means 450.

The automatic inflator 410 includes canister piercing means for piercing the sealed end 424 of the pressurized gas canister 420. In a preferred embodiment, the canister piercing means comprises a plunger 462 which is slidably mounted within a bore 464 formed in the housing 412. A piercing pin 466, having a pointed end, is insert-molded or otherwise mounted on one end of the plunger 462 and extends outward from the forward end of the plunger 462 facing the canister 420, as shown in FIG. 3. The plunger 462 has a generally tubular, cylindrical shaped. Seal means, such as one or more O-rings 468, are mounted in annular recesses formed about the periphery of the plunger 462 to seal the bore 464 and the plunger 462. A seat 470 is mounted in the second end 472 of the plunger 462 to receive one end of a biasing means, such as a spring 474. The piercing pin 466 has an open-ended notch 467 formed therein which allows gas from the canister 420 to flow from the canister 420 to the conduit 432.

Force generating means are provided for driving the canister piercing means formed of the plunger 462 and the piercing pin 466 into the sealed end 424 of a pressurized gas canister 420 when the water sensor means 450 is immersed in water and generates an output signal to the control means 460. In a preferred embodiment, the force generating means includes a ram 480. The ram 480 is slidably mounted within the bore 464 in the housing 412. The ram 480 includes an enlarged collar 482. A reduced diameter release boss 484 projects from one end of the collar 482 and extends outward therefrom into an internal cavity 486 formed within the ram 480. A cylindrical shaft portion 488 on the ram 480 extends outward from the other side of the collar 482 and has a stop means 490 mounted on an end as shown in FIG. 3.

A reset boss 492 is also formed in the ram 480 and extends inward into the internal cavity 486. The reset boss 492 is formed adjacent a front end of the ram 480. A seat 494 is formed in the front face of the ram 480 and receives the biasing spring 474 which is disposed between the ram 480 and the plunger 462.

A cylindrical sleeve denoted in general by reference number 496 is threadingly mounted internally within the housing 412. The shaft 488 of the ram 480 extends through an inner wall 498 of the sleeve 496, as shown in FIG. 3. The collar portion 486 of the ram 480 slidably engages an internal bore 500 formed in the sleeve 496. A first biasing means 502, such as a coil spring, is mounted in the bore 500 in the collar 496 between the inner surface of the collar 496 and the cylindrical shaft portion 488 of the ram 480. The biasing means 502 biases the ram 480 under force towards the plunger 462.

Figure 4:
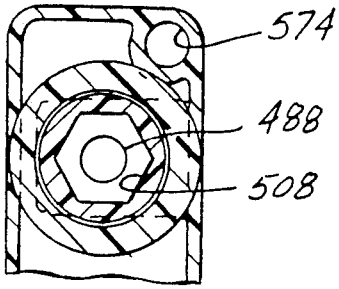
FIG. 4 is a cross sectional view generally taken along line 4—4 in FIG. 3.

The automatic inflator 410 also includes means for resetting the inflator 410 in which the ram 480 is moved to a first, retracted position, as shown in FIG. 3. The resetting means includes a hollow cap 504. The cap 504 has outwardly extending end fingers or flanges 506 formed adjacent one end which engage an annular shoulder formed internally within the housing 412. This rotatably mounts the cap 504 to the housing 412 and allows the cap 504 to be rotated without transverse movement with respect to the housing 412. The internal surface 508 of the bore within the cap 504 preferably has a hexagonal shape as shown in FIG. 4, which slidably mates with a hexagonal exterior surface 510 on one end of the sleeve 496. This allows sliding movement of the sleeve 496 within the cap 504 as the sleeve 496 threadingly engages threads formed in the housing 412 while the cap 504 rotates the sleeve 496. Seal means 507, such as O-ring seals, are mounted in the housing 412 and engage one end of the cap 504 to seal the cap 504 to the housing 412.

As shown in FIG. 3, the biasing means or coil spring 474 is disposed between the plunger 462 and the ram 480. The purpose of the biasing spring 474 is to bias the plunger 462 forward into contact with the sealed end 424 of a gas canister 420 mounted in the housing 412. The biasing means 474 also establishes a space between the end face 472 of the plunger 462 and the front face of the ram 480. This provides a lost travel distance which causes the ram 480 to strike the plunger 462 with a hammer-like, snap effect thereby increasing the force exerted by the ram 480 on the plunger 462 to enable to plunger 462 and the piercing pin 466 to pierce the sealed end 424 of the gas canister 420.

The automatic inflator 410 also includes rotatable release means, denoted in general by reference number 520, which is mounted in the housing 412 and is movable between first and second positions. The rotatable release means 520 blocks movement of the ram 480 from the first, retracted ram position shown in FIG. 3 when the release means 520 is in a first position, shown in FIG. 3, and allows movement of the ram 480 towards the second, extended position when the release means 520 rotates to a second position shown in FIG. 10. The release means 520 is preferably mounted in an internal cavity formed in the ram 480, as shown in FIG. 3. The internal cavity has open top and bottom ends so as to form a through opening completely through the ram 480.

Figure 5:
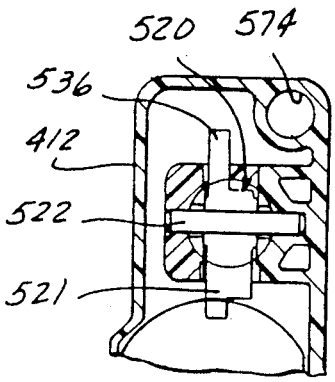
FIG. 5 is a cross sectional view generally taken along line 5—5 in FIG. 3.

The release means 520 preferably comprises a cam 521 which is rotatably mounted on a cam pivot pin 522 fixed within the housing 412 as shown in greater detail in FIG. 5. The cam 521 is formed with a first lobe 524 and a stop 526. The first lobe 524 defines one end of the cam 521. A cam surface 528 extends from the first lobe 524 about the periphery of the cam 521 to the stop 526. The surface 528 of the cam 521 adjacent the first lobe 524 is adapted to engage the release boss 484 on the ram 480 to hold the ram 480 in the first, retracted position shown in FIG. 3 when the cam 521 is in the first position.

The automatic inflator 410 also includes actuator means for rotating the release means 520 between the first and second positions. In a preferred embodiment, the actuator means comprises a cam moving means including a uni-directional electrical motor 530 which is mounted in the housing 412. The motor 530 includes a rotatable output shaft 532 having a gear means 534 mounted on an exterior end thereof. The gear means 534 preferably comprises a worm gear 534. The worm gear 534 is held in place in a groove formed internally within the housing 412. A primary gear 536 meshingly engages the worm gear 534. The primary gear 536 is fixedly connected to, such as by molding, with the cam 521, as shown in FIG. 5. The primary gear 536 is rotatably mounted on and rotates about the pivot pin 522 upon rotation of the worm gear 534 when the motor 530 is activated.

Upon activation of the motor 530, as described hereafter when the control means 460 receives an output signal from the water sensor means 450, the motor 530 will rotate the motor output shaft 532 and the attached worm gear 534. This will cause counter-clockwise rotation of the primary gear 536 and a simultaneous rotation of the cam 521 from the first position shown in solid in FIG. 3 to a second position shown in FIG. 10. During such rotation, the first lobe 524 will slip past the release boss 484 on the ram 480 enabling the ram 480 to advance to the right, in the orientation shown in FIG. 3 under the influence of the biasing spring 502. The motor 530 will be activated for a predetermined amount of time, such as one second, to rotate the cam 521 between the first and second positions. At the completion of the preset time period, the motor 530 will be deactivated leaving the cam 521 in the second position shown in FIG. 10.

Figure 10:
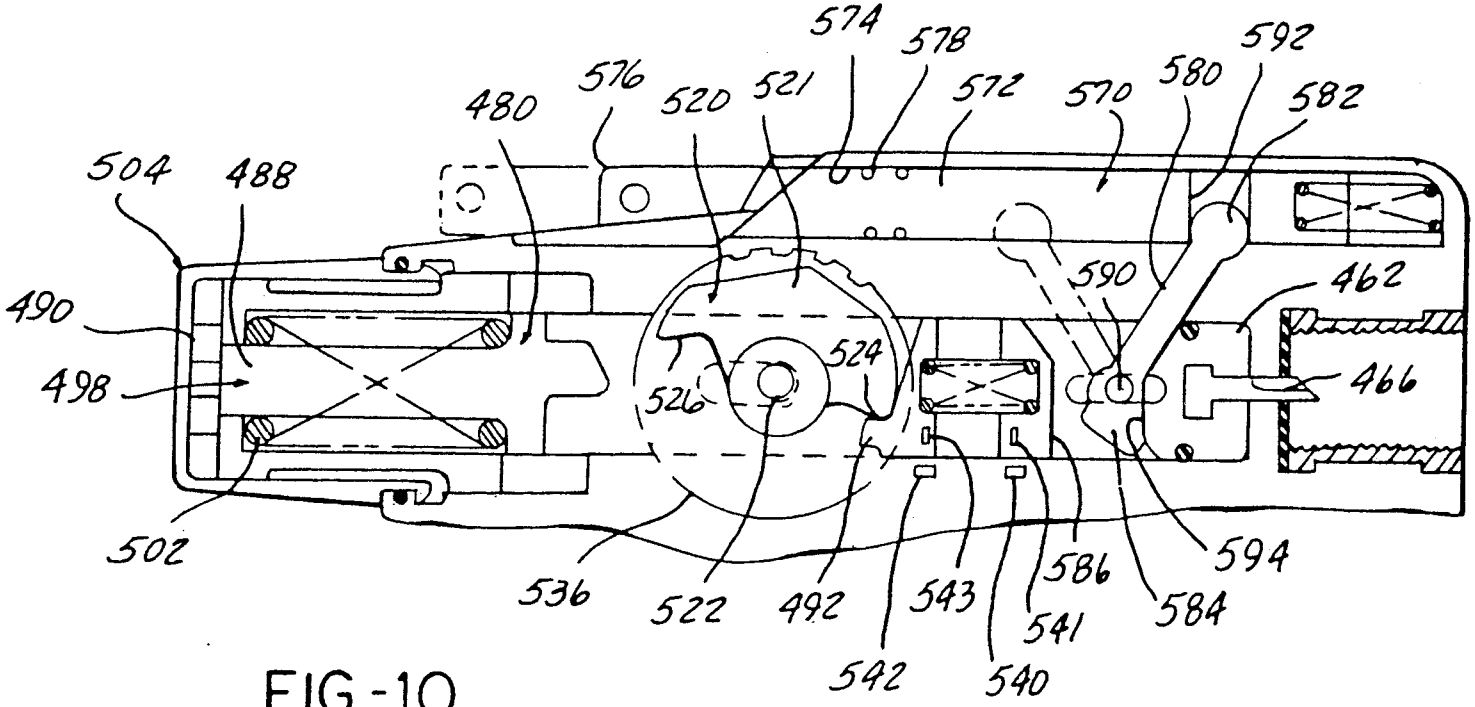
FIG. 10 is a partial view of the internal components shown in their operative positions during the resetting of the automatic inflator.

As shown in FIG. 10, a plunger position detector means 540 is mounted in the housing 412 to detect the retracted position of the plunger 462. The position detector means 540 is preferably a switch, such as a limit switch or a proximity switch. In a preferred embodiment, the switch is a Hall effect-type proximity switch which detects the presence of a magnet 541 mounted in the plunger 462. The detector means 540 provides an indication that the plunger 462 is in its retracted position, such as shown in solid in FIG. 3, as will occur when the automatic inflator 410 is reset and a sealed gas container 420 is inserted into the housing 412. Insertion of the gas canister 420 into the housing 412 urges the piercing pin 466 and the plunger 462 to the left, in the orientation shown in FIG. 3, into the housing 412 compressing the biasing spring 474. However, the biasing spring 474 which is seated between the ram 480 and the plunger 462, maintains contact between the piercing pin 466 and the surface of the sealed end 424 of the gas canister 420. When the piercing pin 466 has pierced the canister 420 or when no canister 420 is mounted in the housing 412, the detector means 540 will not be made thereby providing an indication to the control means 460 that a pierced canister 420 or no canister 420 is in the housing 412.

A second position detector 542 is also mounted within the housing 412 and detects the position of the ram 480 in its first, retracted position, as shown in solid in FIG. 3. The second position detector 542 may also be any type of switch, such as a limit switch or a Hall-type proximity switch. In the latter example, the switch detects a magnet 543 mounted in the ram 480. When the ram 480 is in the retracted position shown in FIG. 3, the second position detector 542 will generate an output signal indicating that the ram 480 is in its retracted position. However, when the ram 480 has moved to its extended position, after the automatic inflator 410 has been activated, the second position detector 542 will not be made so as to also provide an indirect indication of the position of the ram 480.

Referring now to FIG. 9, there is depicted a schematic block diagram of the control means 460 employed in the automatic inflator 410. As shown therein, the control means 460 includes a central processing unit 462 which receives inputs and generates outputs to control the operation of the automatic inflator 410. The central processing unit 462 receives inputs from the water sensor means 450 which have been conditioned by suitable signal conditioning circuitry 544, such as signal conditioning circuits sold by Motorola, Model Numbers MMBD7000 and MMBD2826, for example. Also input to the central processing unit 462 are the output of the first and second detector means 540 and 542 which respectively detect the positions of the plunger 462 and the ram 480. A push-to-test input button 546 is mounted in the housing 412 and extends outward from the housing 412 as shown in FIG. 1. The use of the push-to-test button 546 will be described in detail hereafter with the automatic and reset operations of the automatic inflator 10. Finally, the electrical power source 434 is input through a suitable power supply circuit 548, such as a diode, and a voltage comparator circuit, National Semiconductor Model No. LM 2903, to the central processing unit 462.

Outputs from the central processing unit 462 include a motor driver circuit 550, Motorola Model No. TIP 127, which drives the motor 530. Suitable driver circuits 552 and 562, such as Siliconix Model No. 2N7004 FET, are also connected to outputs of the central processing unit 462 and to indicators 558 and 560, respectively. The status indicator 558 indicates when the canister 420 is pierced, as detected by the plunger position detector 540. The indicator 560 provides an indication that the ram 480 is in its first, retracted position and the automatic inflator 410 is reset, ready for activation. The indicators 558 and 560 may be any suitable type of indicator, such as a light emitting diode. A fault indicator 168 and fault driver 164 may optionally be provided as an output from the central processing unit 462 to indicate any internal fault condition in the inflator 410. The fault indicator 168 would be mounted in the housing 412 so as to be viewable externally from the housing 412.

Finally, a test connector input 556 is connected through suitable conditioning circuitry 554, such as Motorola Model Numbers MMBD7000 and MMBD2836, as an input to the central processing unit 462 for connecting a test connector to the control means 460. This enables the control means 460 to be tested during assembly or any time during its use for proper operation. The test connector 556 is mounted, preferably by insert molding, at one end of the bore 438 housing the batteries 436 as shown in FIG. 3.

The following description describes the reset procedure required to reset the automatic inflator 410 for operation. Upon initialization of the automatic inflator 410, two batteries 436 are inserted into the housing 412 by removing the battery cap 444 and inserting the batteries 436, positive end first, into the housing 412. The battery cap 444 is then threadingly attached to the housing 412.

At this point, as well as any time before the automatic inflator 410 is to be reset, the user must engage or push the test push button 546. If the automatic inflator 410 requires resetting, the indicator 560 will light red showing that a reset is required. An unlit indicator 560 indicates that the automatic inflator 410 is ready for use.

Assuming that a reset of the automatic inflator 410 is required, the reset cap 504 is rotated counter-clockwise. Due to the interlocking hexagonal shapes of the bore 508 in the reset cap 504 and one end 510 of the sleeve 496, rotation of the reset cap 504 with respect to the housing 412 causes the sleeve 496 to move to the left in the orientation shown in FIGS. 3 and 10 through the threads on the sleeve 496 which engage the threads in the housing 412. During such transverse movement, the end 498 of the sleeve 496 will engage the stop 490 on the end of the ram 480 thereby pulling the ram 480 to the left until the stop 490 engages the end face of the reset cap 504 as shown in FIG. 10. It should be noted that during such movement of the sleeve 496 and the ram 480, the biasing means 502 is completely relaxed or decompressed.

During such movement, the release boss 484 integrally molded to the collar 486 of the ram 480 has moved to the position shown in FIG. 10. Simultaneously, the reset boss 492 on the ram 480 has moved to a position shown in FIG. 10 since the cam 521 is in its upper position after activation of the automatic inflator 410.

The operator then pushes the test push button 546 which, not only performs a self-test of the automatic inflator 410 when the ram 480 and the plunger 462 are in their ready positions, but also energizes the motor 530 and, by way of the gears 534 and 536, causes the release cam 521 to rotate counter-clockwise until the stop or catch portion 526 engages the reset boss 492 on the ram 480, as shown in FIG. 3. This movement positively locates the position of the cam 521 relative to the release boss 484.

Next, the main biasing spring 502 must be pre-loaded or cocked. This is accomplished by rotating the reset cap 504 in the opposite direction from the initial reset operation or clockwise. This rotation of the reset cap 504 moves the sleeve 496, the spring 502 and the ram 480 to the right, in the orientation shown in FIGS. 3 and 10, until the release boss 484 on the ram 480 touches the release cam 521, as shown in FIG. 3. As the operator continues to rotate the release cap 504, the threaded movement of the sleeve 496 compresses the spring 502 until the sleeve 496 has traveled to the end of its stroke and has bottomed out on the internal shoulder of the housing 412. The automatic inflator 410 is then considered "cocked" and ready for activation, either automatically or manually, as described hereafter. Also, at this point the ram 480 is in its ready position and has closed the ram position detector 542 so that when the test push button 546 is pushed once, the reset indicator 560 will remain unlit indicating a reset state for the inflator 410.

The next step in the initial preparation of the automatic inflator 410 is to install a sealed gas canister 420. The operator inserts a new canister 420 into the housing 412 and rotates the gas canister 420 until it is firmly seated in the bore 426 in engagement with the gasket seal 430. As the canister 420 is inserted, the sealed face 424 of the canister 420 contacts the end of the piercing pin 466 and causes the plunger 462 which is attached thereto to retract or move to the left in the orientation shown in FIG. 3, against the bias of the spring 474. When the canister 420 is fully seated or bottomed out in the insert 428 in the housing 412, the plunger position detector 540 will close and, subsequently, when the push-to-test button 546 is depressed, the canister indicator 558 will light. The automatic inflator 410 is now ready for use.

The following description describes the automatic operation of the automatic inflator 410 in inflating an inflatable article when the inflator 410 is immersed in water. Upon water submersion, the water will close or bridge the two separate water sensor probes 452 to close a circuit through water conductance between the probes 452. When the electrical path between the probes 452 has been non-interruptedly made for a predetermined period of time, which can be pre-programmed in the central processing unit 462, the central processing unit 462 will activate the motor 530 which, through the gears 534 and 536, causes counter-clockwise rotation of the release means 520 from the position shown in FIG. 3 to a position wherein the release boss 484 has cleared the first lobe 524 on the release means 520. Upon reaching this threshold, the biasing force of the spring 502 will cause a snap-release of the ram 480 such that the forward surface of the ram 480 will strike the trailing surface 472 of the plunger 462 thereby driving the piercing pin 466 mounted on the opposite end of the plunger 462 into the sealed end 424 of the canister 420 piercing the canister 420 and allowing the pressurized gas to escape therefrom. The pressurized gas flows through the notch 467 in the piercing pin 466 through the gas flow conduit 432 in the housing 412 to the outlet shaped to match the valve 418 and through the the valve 418 to the inflatable article. This provides inflation of the article.

It should be noted that for larger inflatable articles requiring greater amounts of pressurized gas for inflation, the automatic inflator 410 of the present invention may be easily modified to accept two separate, pressurized gas canisters. This modification also requires a duplication of the plunger 480, cam means 520, plunger 462 and piercing pin 466 for each pressurized canister 420.

The automatic inflator 410 may also be manually activated. Such manual operation utilizes a manual lanyard means denoted in general by reference number 570 in FIG. 10. The manual lanyard 570 includes a lanyard shaft 572 slidably mounted in a bore 574 formed in the housing 412. One end 576 of the lanyard shaft 572 extends outward from the housing 412, as shown in FIGS. 1, 3 and 10. Suitable seal means, such as one or more O-rings 578, are mounted in annular recesses on the shaft 572 to seal the shaft 572 to the bore 574 in the housing 412.

The manual lanyard means 570 also includes a lanyard link 580 having a first end 582 and a second end 584. The second end 584 of the link 580 is mounted in a recess 586 formed in the plunger 462. The lanyard link 580 is pivotally connected to the housing 412 by a shaft 590 mounted in the housing 412.

The first end 582 of the link 580 is mounted in a recess 592 formed in the shaft 572 to couple or connect the link 580 to the shaft 572. The second end 584 of the link 580 has a cam surface 594 formed on one side which engages the forward end of the plunger 462, as shown in FIGS. 3 and 10.

The lanyard link 580 is movable between a first position shown in solid in FIG. 10 in which the cam surface 592 merely touches the plunger 462 and a second position shown in phantom in FIG. 10 which results from a transverse pulling or movement of the shaft 572, such as by an operator, at which time the cam 594 engage the plunger 462 under force and urges the plunger 462 to the right driving the piercing pin 466 into the sealed end 424 of a canister 420 mounted in the housing 412. As shown in FIG. 8, the link 580 extends angularly from a vertical plane through the plunger 462 such that the shaft 572 is offset from a vertical plane through the plunger 462. This allows a direct transverse movement of the lanyard without excessive force being placed on the link 580 and enables the automatic inflator 410 to be constructed with a reduced size.

Figure 11:
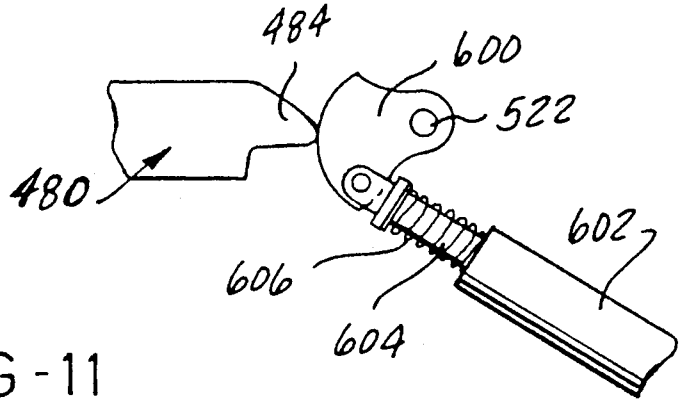
FIG. 11 is a partial elevational view of an alternate embodiment of the cam moving means employed in the automatic inflator of the present invention.

Referring now to FIG. 11, there is illustrated another means for rotating the cam means 520 which releases the ram 480 from its first, retracted position. In this embodiment, a cam 600 is pivotally mounted to the pivot pin or shaft 522 in the housing 412. In the first, retracted position, the release boss 484 on the ram 480 engages the peripheral edge of the cam 600. A cam moving means in the form of an electromechanical solenoid 602 is mounted in the housing 412. A retractable and extensible plunger 604 extends outward from the solenoid 602 and is pivotally connected at one end to the cam 600. A biasing spring 606 is mounted about the plunger 604 for normally biasing the plunger 604 outward from the solenoid 602. When the control means 460 detects immersion in water, as generated by an output signal from the water sensor means 450, the control means 460 activates the solenoid 602 to retract the plunger 604 which causes a rotation of the cam 600 about the shaft 522. This rotates the cam 600 from the first position shown in solid in FIG. 11 to a second position in which the release boss 484 is freed from the cam 600 enabling the ram 480 to move from the first, retracted position to the second, extended position under the force of the biasing spring 502. The other components of the automatic inflator are identical to those described above and shown in the remaining figures of the drawing.

In summary, there has been disclosed a unique inflator for inflatable articles which automatically inflates such articles upon immersion in water. The inflator is also manually actuated by means of a manually operable lanyard. The inflator uniquely provides an indication of the condition of a pressured gas canister and a visible indication of whether the canister is sealed, thereby indicating a fully pressurized canister, or if it has been pierced and is therefore empty. This enables the operative state of the inflator to be easily detected at any time during storage and prior to use. Further, an externally controlled reset means is mounted in the inflator housing to reset the force generating means in the first position blocked from engagement with the canister piercing means. This enables the inflator to be easily reset for subsequent use without requiring access to the interior mounted components of the inflator.

What is claimed is:

1. An inflator for inflatable articles comprising:

a housing;

means, formed in the housing, for discharging gas therefrom;

a pressurized gas canister attachable to the housing and having a sealed end disposed in fluid flow communication with the gas discharging means;

canister piercing means movably mounted in the housing for piercing the sealed end of the canister;

an electrical power source mounted within the housing;

water sensor means, mounted within the housing and extending partially outward therefrom, for generating an output signal when immersed in water;

force generating means, mounted in the housing, for driving the canister piercing means into the sealed end of the canister;

rotatable release means, mounted in the housing and rotatable between first and second positions, for blocking the force generating means from engaging the canister piercing means when the release means is in the first position and allowing the force generating means to forcibly engage the canister piercing means when the release means is in the second position; and actuator means, mounted in the housing and connected to the electrical power source and the water sensor means, for rotating the release means from the first to the second position in response to an output signal from the water sensor means.

2. The inflator of claim 1 wherein the canister piercing means comprises:

a plunger movably mounted within the housing with respect to and facing the canister; and a canister piercing pin mounted on and extending outward from the plunger.

3. The inflator of claim 1 wherein the rotatable release means comprises:

cam means mounted in the housing and movable between first and second positions.

4. The inflator of claim 1 further including:

first detector means, mounted within the housing, for detecting the attachment of a sealed canister to the housing, the first detector means being input to the actuator means.

5. The inflator of claim 1 further including:

second detector means, mounted within the housing, for detecting the force generating means in the first, retracted position, the second detector means being input to the actuator means.

6. The inflator of claim 1 further including:

status indicator means, mounted in the housing and visible exteriorly from the housing, for indicating the operative status of the actautor means.

7. The inflator of claim 1 further including:

first detector means, mounted within the housing, for detecting the attachment of a sealed canister to the housing, the first detector means being input to the actuator means; and second detector means, mounted within the housing, for detecting the force generating means in the first, retracted position, the second detector means being input to the actuator means.

8. The inflator of claim 7 further including:

status indicator means, mounted in the housing and visible exteriorly from the housing, for indicating the operative status of the actuator means.

9. The inflator of claim 1 further including:

manual actuating means for urging the canister piercing means into the gas canister.

10. The inflator of claim 9 wherein the manual actuating means comprises:

a bore formed in the housing;

a shaft slidably mounted in the bore and having a first end extending outward from the housing;

a link mounted within the housing and having first and second ends, the first end of the link being pivotally mounted in the housing and acting on the canister piercing means;

the second end being connected to the shaft; and cam means, mounted on the second end of the link and acting on the canister piercing means, for urging the canister piercing means toward the canister.

11. The inflator of claim 1 wherein the housing comprises:

a pre-molded plastic case having internal cavities formed therein.

12. The inflator of claim 11 wherein the case further includes:

a base containing the cavities; and a plastic cover engageably covering the internal cavities in the base and insert-molded to the base at a common perimeter joint line therebetween.

13. The inflator of claim 11 wherein the case further comprises:

a base containing the cavities; and a plastic cover engageably covering the internal cavities in the base and ultrasonically welded at a common perimeter joint line to the base.

14. The inflator of claim 1 wherein the actuator means comprises:

means for moving the release means between first and second positions; and control means, mounted in the housing and connected to the electrical power source and the water sensor means, for activating the actuator means to move the release means from the first to the second position in response to an output signal from the water sensor means.

15. The inflator of claim 14 wherein the means for moving the release means comprises:

an electromagnetic solenoid activated by the control means and having a reciprocating plunger, the plunger connected to the release means for rotating the release means between the first and second positions.

16. The inflator of claim 14 wherein the means for moving the release means comprises:

motor means having a rotatable output shaft, the motor means being activated by the control means; and gear means, coupled between the output shaft of the motor means and the release means, for rotating the release means.

17. The inflator of claim 16 wherein the gear means comprises:

a first gear driven by the motor output shaft; and a second gear fixedly mounted on the release means and meshingly coupled to the first gear.

18. The inflator of claim 1 wherein the force generating means comprises:

a ram movably mounted within the housing and movable between a first, retracted position and a second, extended position acting on the canister piercing means to drive the canister piercing means into the canister; and a first biasing means, mounted in the housing, for biasing the ram under force toward the second position.

19. The inflator of claim 18 wherein:

the rotatable release means comprises a cam means mounted in the housing and movable between first and second positions;

a cavity formed internally in the ram; and the cam means rotatably mounted in the housing and disposed in the cavity in the ram.

20. The inflator of claim 18 further including:

externally controlled reset means for resetting the ram to the first, retracted position.

21. The inflator of claim 20 wherein the reset means comprises:

a cap rotatably mounted on the housing, the cap having an internal bore;

a sleeve transversely and fixedly mounted within the bore in the cap, the sleeve having a first threaded end portion threadingly coupled to the housing for extending and retracting the sleeve as the cap rotates;

the ram slidably extending through the sleeve;

the first biasing means being mounted between the sleeve and the ram;

stop means, mounted on the end of the ram and engaged by the sleeve as the sleeve retracts, for moving the ram to the first, retracted position; and the actuator means being responsive to the ram reaching the first, retracted position for rotating the rotatable release means to the first position blocking the ram from engaging the canister piercing means.

22. The inflator of claim 21 further including:

control means, responsive to the ram in the first, retracted position and depression of a test push button, for rotating the cam to the first position.

23. An inflator for inflatable articles comprising:

a housing;

means, formed in the housing, for discharging gas therefrom;

a pressurized gas canister attached to the housing and disposed in fluid flow communication with the gas discharging means;

canister piercing means, movably mounted within the housing with respect to and facing the canister, for piercing the sealed end of the canister;

an electrical power source mounted within the housing;

water sensor means, mounted within the housing and extending partially outward therefrom, for generating an output signal when immersed in water;

a ram movably mounted within the housing and movable between a first, retracted position and a second, extended position acting on the plunger to drive the canister piercing pin into the canister;

a first biasing means for biasing the ram toward the second position;

cam means, mounted in the housing and movable between first and second positions, for blocking movement of the ram from the first, retracted ram position when the cam means is in the first position and allowing movement of the ram toward the second, extended ram position when the cam means is in the second position;

means, mounted in the housing, for moving the cam means between the first and second positions; and control means, mounted in the housing and connected to the electrical power source, the cam moving means and the water sensor means, for activating the cam moving means to move the cam means from the first to the second position in response to the output signal from the water sensor means.

24. The inflator of claim 23 wherein the canister piercing means comprises:

a plunger movably mounted within the housing with respect to and facing the canister; and a canister piercing pin mounted on and extending outward from the plunger.

25. The inflator of claim 23 wherein the cam moving means comprises:

an electromagnetic solenoid activated by the control means and having a reciprocating plunger, the plunger connected to the cam means for rotating the cam means between first and second positions.

26. The inflator of claim 23 further including:

first detector means, mounted within the housing, for detecting the attachment of a sealed canister to the housing, the first detector means being input to the control means.

27. The inflator of claim 23 further including:

second detector means, mounted within the housing, for detecting the ram in the first, retracted position, the second detector means being input to the control means.

28. The inflator of claim 23 further including:

first detector means, mounted within the housing, for detecting the attachment of a sealed canister to the housing, the first detector means being input to the control means; and second detector means, mounted within the housing, for detecting the ram in the first, retracted position, the second detector means being input to the control means.

29. The inflator of claim 23 further including:

status indicator means, mounted in the housing and visible exteriorly from the housing, for indicating the operative status of the control means.

30. The inflator of claim 23 wherein the cam moving means comprises:

motor means having a rotatable output shaft, the motor means being activated by the control means; and gear means, coupled between the output shaft of the motor means and the cam means, for rotating the cam means.

31. The inflator of claim 30 wherein the gear means comprises:

a first gear driven by the motor output shaft; and a second gear fixedly mounted on the cam means and meshingly coupled to the first gear.

32. The inflator of claim 23 further including externally controlled reset means for resetting the ram to the first, retracted position.

33. The inflator of claim 32 wherein the reset means comprises:

a cap rotatably mounted on the housing, the cap having an internal bore;

a sleeve transversely and fixedly mounted within the bore in the cap, the sleeve having a first threaded end portion threadingly coupled to the housing for extending and retracting the sleeve as the cap rotates;

the ram slidably extending through the sleeve;

the first biasing means being mounted between the sleeve and the ram;

stop means, mounted on the end of the ram, and engaged by the sleeve as the sleeve retracts, to move the ram to the first, retracted position; and the control means being responsive to the ram reaching the first, retracted position for rotating the cam means to the first position blocking the ram from engaging the canister piercing means.

34. The inflator of claim 23 wherein the housing comprises:

a pre-molded plastic case having internal cavities formed therein.

35. The inflator of claim 34 wherein the case further includes:

a base containing the cavities; and a plastic cover engageably covering the internal cavities in the base and insert-molded to the base at a common perimeter joint line therebetween.

36. The inflator of claim 34 wherein the case further comprises:

a base containig the cavities; and a plastic cover engageably covering the internal cavities in the base and ultrasonically welded at a common perimeter joint line to the base.

* * * * *